United States Patent [19]

Manesse et al.

[11] Patent Number: 4,596,494

[45] Date of Patent: Jun. 24, 1986

[54] DEVICE FOR POSITIONING AND APPLYING TENSION TO A SET OF RODS FOR HOLDING A PARTIALLY SUBMERGED PLATFORM

[75] Inventors: Jean-Pierre Manesse, Basse Goulaine; André Bourgeois; Daniel Fleury, both of Nantes, all of France

[73] Assignee: Ateliers et Chantiers de Bretagne-ACB, Nantes, France

[21] Appl. No.: 450,612

[22] Filed: Dec. 17, 1982

[30] Foreign Application Priority Data

Dec. 18, 1981 [FR] France ..... 81 23664

[51] Int. Cl.[4] ..... B63C 35/44; E02B 17/00

[52] U.S. Cl. ..... 405/196; 405/224

[58] Field of Search ..... 405/195, 224, 196; 114/264, 265; 175/5, 7, 9

[56] References Cited

U.S. PATENT DOCUMENTS 3,943,868 3/1976 Person et al. ..... 114/264
3,949,883 4/1976 Crooke et al. .
3,983,828 10/1976 Stram .
4,379,657 4/1983 Widiner et al. ..... 405/195
4,449,854 5/1984 Nayler ..... 405/195

*Primary Examiner*—David H. Corbin
*Attorney, Agent, or Firm*—Sughrue, Mion, Zinn Macpeak & Seas

[57] ABSTRACT

A device for positioning and applying tension to a set of rods (5) for holding a partially submerged platform wherein the device includes a metal frame, (12, 13A, 13B, 13C, 13D, 14), means for vertically moving said frame relative to the platform, at least one jack (21 22) of a first type which has a cylinder and a rod, at least one jack (31,32) of a second type which has a cylinder and a rod, the cylinders of the rods being fast to said frame and being disposed in such a way that the rods move vertically, the rod of the jack of the first type being fast to a plate (25) which is provided firstly with an orifice for the rod of the second type of jack to pass through and secondly with means of fixing to the end of the set of rods, the rod of the second type of jack having a stop (31, 32) at its end, the rods of the jacks of both types being of unequal length and being chosen in such a way that the jack of the second type drives the plate only in the platform immersion step. Application to oil well drilling.

6 Claims, 33 Drawing Figures

V
1
5
6
6A
7
7A
8

80A
80
80B
10A
10B
11A
11B
13A
13B
1
5
6A
6
3

80
1
5
6
3

80
1
5
6
3

80A
80B
80
90
1
5
6
3

80
80A
80B
10A
10B
11A
11B
13A
13B
90
1
5
6
6A
7A
7
3

DEVICE FOR POSITIONING AND APPLYING TENSION TO A SET OF RODS FOR HOLDING A PARTIALLY SUBMERGED PLATFORM

The present invention relates to a device for positioning and applying tension to a set of rods for holding a partially submerged platform.

BACKGROUND OF THE INVENTION

The exploitation of undersea oil resources has led to the development of various types of platform and in particular of permanent platforms provided with columns which stand on a foundation resting on the sea bed.

The deeper the sea, the higher the cost of these structures.

Further, the above type of platform cannot be envisaged when the depth of the sea exceeds several hundreds of meters.

That is why normally-floating platforms have been invented which are deliberately kept submerged so as to reduce the effects of the swell (pounding, rolling and pitching). They are kept partially submerged by means of rods each having one end fixed to the sea bed and the other end fixed to the platform.

The immersion process is illustrated in FIGS. 1A to 1F. FIG. 1A illustrates a fragment of the platform 1 floating on the sea whose surface is referenced 2 and whose bed is referenced 3. The rods which support the platform are assembled end to end in a passage 4 in accordance with a technique which is well-known in the field of oil well drilling so as to constitute a set of rods 5.

The set of rods ends in a male connector 6 designed to co-operate with a female connector 7 fixed in a solid mass 8 fixed in the sea bed (see FIG. 1C).

Said male connector is of the type equipped with fixing fingers which open automatically like a corola when enough pressure is applied to their ends; the female connector has a step which co-operates with the fingers to make the two components fast together.

When the set of rods has been assembled (FIG. 1A), it is raised (FIG. 1B) so that its bottom end is at a higher level than the solid mass, with a margin which takes pounding into account to avoid the danger of shocks.

The set of rods is moved to a position above the female connector (FIG. 1C) and is then lowered (FIGS. 1D and 1E) so as to insert the male connector in the female connector with sufficient pressure to open the fixing fingers 6A of the male connector.

Lastly, the platform and the set of rods are moved relative to each other so as to partially immerse the platform which is then practically prevented from moving and made insensitive to the movements of the sea.

At the end of the partial immersion step, the top end 5A of the set of rods is made fast to the platform.

The preceding description relates to a single set of rods: it is obvious that the platform is equipped with a plurality of sets of rods operated simultaneously and in synchronism.

For example, a plurality of sets of rods are placed at each of the four corners of a square platform.

Preferred embodiments of the invention provide a device which controls the movements of a set of rods in a positioning sequence such as the one which has just been described.

It should be observed that the problem is harder to solve than it seems. In particular, the device must be able to cause movements in a system whose apparent weight can vary over a wide range depending on the stage of the operation (e.g. from about one hundred tons to about one thousand tons), while being sensitive to weights of about ten tons, in particular to ensure proper and reliable operation of the automatic connector.

Further, the device must be able to cause movements of the set of rods over an amplitude of about ten meters yet without requiring special jacks to be manufactured which do not fall within manufacturers' usual production standards for jacks.

Preferred embodiments of the invention further provide a device in which the rods can be positioned with damping means which permanently damp shocks and the effects of the swell.

SUMMARY OF THE INVENTION

The invention provides a device for positioning and applying tension to a set of rods for holding a partially submerged platform wherein the device includes a metal frame, means for vertically moving said frame relative to the platform, at least one jack of a first type which has a cylinder and a rod, at least one jack of a second type which has a cylinder and a rod, the cylinders of the jacks being fast to said frame and being disposed in such a way that the rods move vertically, the rod of the jack of the first type being fast to a plate which is provided firstly with an orifice for the rod of the second type of jack to pass through and secondly with means of fixing to the end of the set of rods, the rod of the second type of jack having a stop at its end, the rods of the jacks of both types being of unequal length and being chosen in such a way that the jack of the second type drives the plate only in the platform immersion step.

Preferably, the jacks are disposed inside the frame.

Preferably, the means for moving the frame include sliders mounted to slide along the beams to which the platform can be made fast.

Advantageously, each jack is connected to damping means.

The damping means for damping the jack of the second type is a tank partially filled with oil and compressed air and communicating with the jacks via a controllable non-return valve.

The damping means for damping the jack of the first type is a device with two cylinders and two pistons which are connected together by a single rod, the first piston delimiting in the first cylinder two compartments respectively connected to said jacks and to a compressed gas source, the second piston delimiting in the second cylinder two chambers each of which can be made to communicate via a controllable valve with either a compressed gas source or the atmosphere.

BRIEF DESCRIPTION OF THE DRAWINGS

An embodiment of the invention is described with reference to the accompanying drawings in which:

FIGS. 1A', 1B', 1C', and 1D', are explanatory diagram of a device embodying the invention;

MORE DETAILED DESCRIPTION

FIGS. 1A to 1F have already been described.

Figures 1A, 1B, 1C, 1D, 1E, 1F:
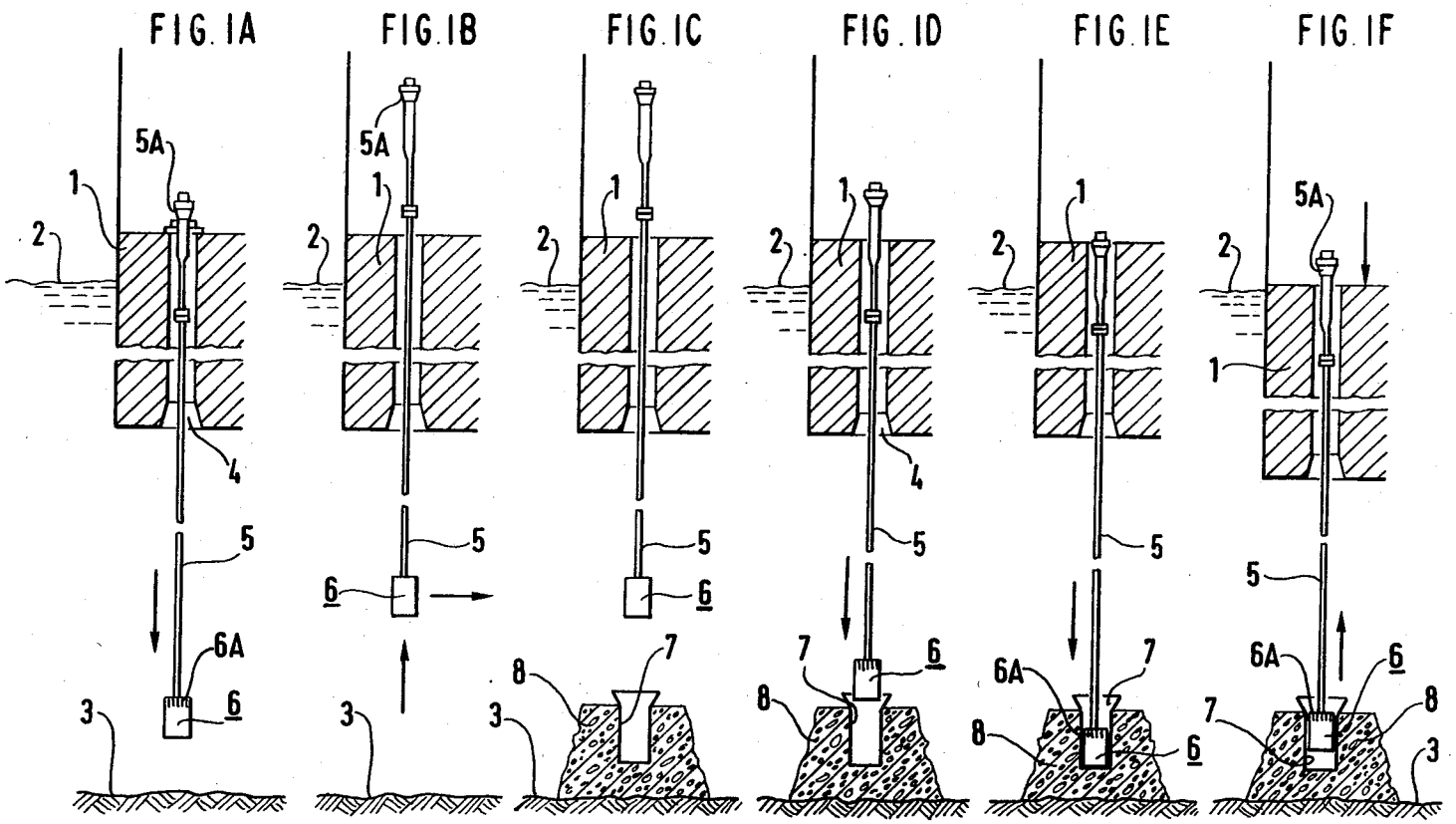
FIGS. 1A, 1B, 1C, 1D, 1E, and 1F are explanatory diagrams showing how a set of rods is positioned and how tension is applied thereto.
Figures 1A, 1B, 1C, 1D:
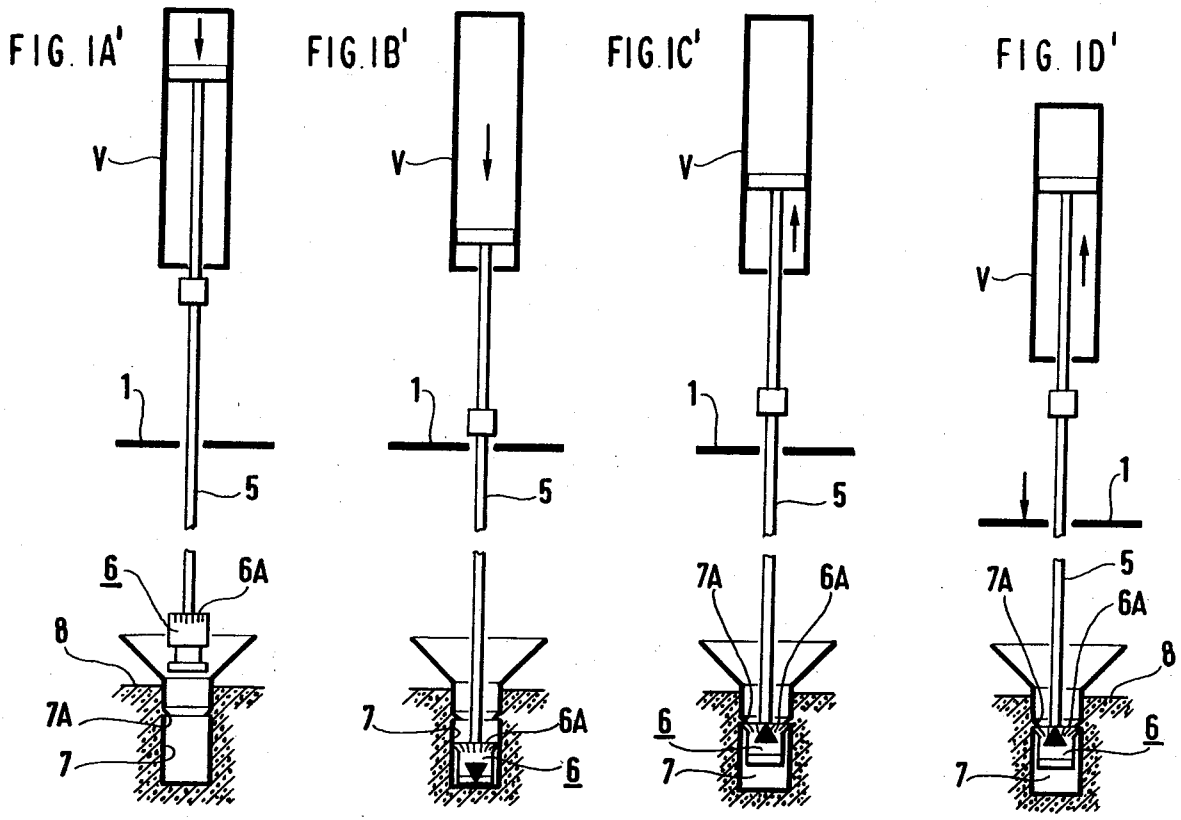
Figure 2:
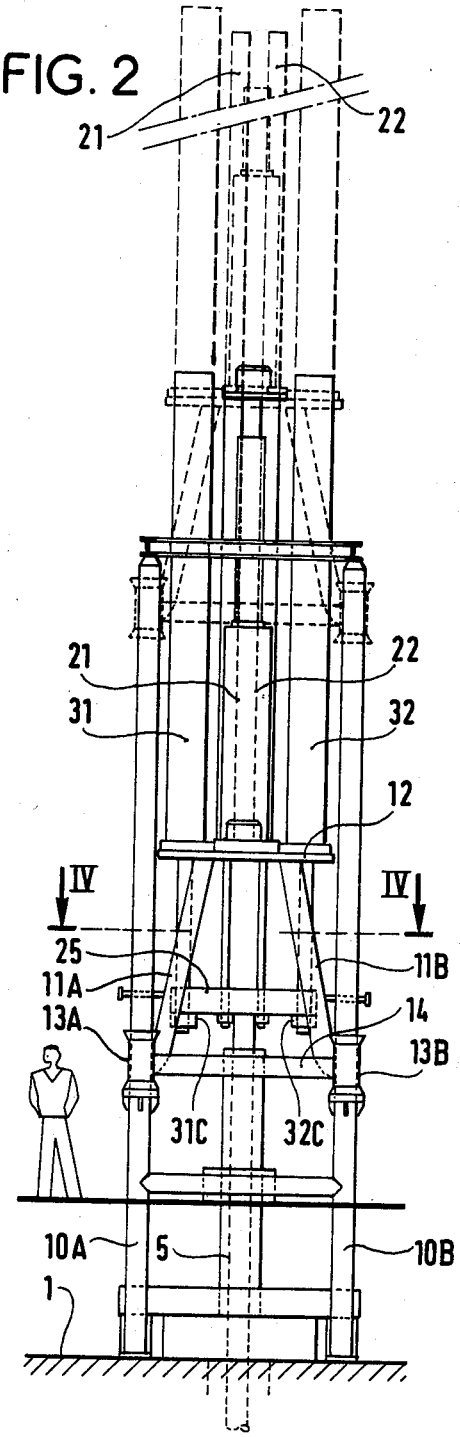
FIG. 2 is a front elevation view of a preferred embodiment of the device in accordance with the invention corresponding to that of FIG. 8B.
Figure 3:
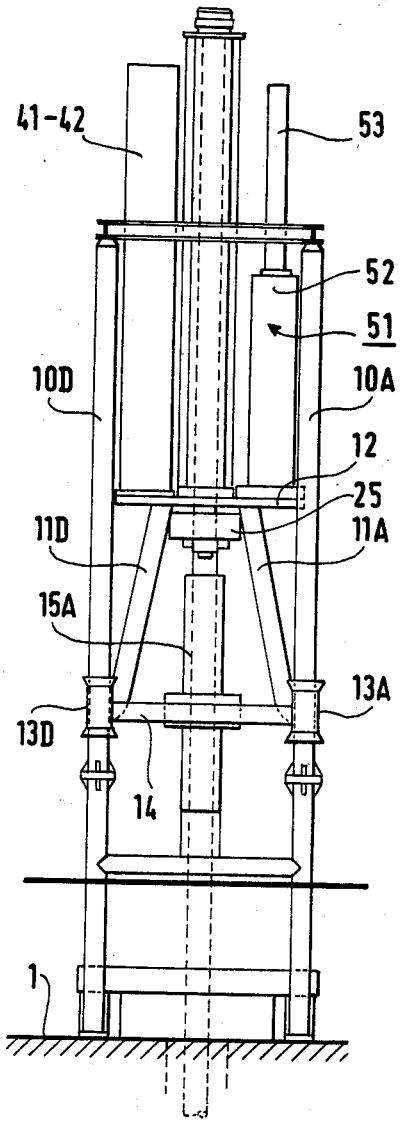
FIG. 3 is a side elevation of the same device with components at different positions from that of FIG. 2, corresponding to that of FIG. 8D.

FIG. 1A'-1D' will be described after the description with reference to FIGS. 2 to 6 of a preferred embodiment of the invention.

The device includes a set of beams 10A, 10B, 10C, 10D, connected together so as to constitute a rigid outer framework and which can be made fast to the platform 1. The device also includes a metal frame constituting the movable equipment on the platform 1 having, in particular, four cross-pieces 11A, 11B, 11C,11D whose upper ends are fixed to an upper plate 12 and whose lower ends are fixed to sliders 13A, 13B, 13C, 13D inserted in the beams 10A to 10D. A plate 14 connected to the sliders imparts rigidity to the frame thus constituted which can move slidably along the set of beams.

The device in accordance with the invention further includes two identical jacks 21 and 22 whose cylinders 21A and 22A are fixed to the frame parallel to the beams so as to move vertically and symmetrically relative to the centre O of the device. Two jacks of a first type are used for reasons of symmetry in assembly. In variants, a single jack or more than two jacks of the first type could be used.

The rods 21B and 22B of the jacks are connected to a thick plate 25 (see FIG. 6) which includes means on which to fix the end 5A of the set of rods 5.

The jacks 21 and 22 are chosen, for example, to have a strength of about 120 tons if the weight of the set of rods is about 100 tons.

The device further includes two other jacks 31 and 32 whose strength is greater than that of the jacks 21 and 22.

As previously, two jacks of this second type are chosen for reasons of symmetry. In variants, a single jack or more than two jacks of the second type could be used.

The jacks 31 and 32 are identical to each other and have cylinders 31A and 32A disposed vertically in the frame and integral therewith. They are placed symmetrically relative to the centre O. Their pistons 31B and 32B pass through the plate 25 and can slide therein in a push fit. They end in stops 31C and 32C. Said arrangement allows the set of rods to operate with the jacks 21 and 22 only during steps illustrated by FIGS. 1A', 1B', 1C', 1D', 1E' and in which some degree of sensitivity is required; the jacks 31 and 32 come into action only for the platform partial immersion step F. Their force is, for example, in the neighbourhood of 1000 tons.

FIG. 1A' shows the advantage of two pairs of jacks. In that step when the set of rods 5 is lowered, the force exerted on the jacks symbolically shown in the Figure by a single jack V is, for example, about 100 tons.

At the time when the male connector 6 comes into contact with the bottom of the female connector 7 (step of FIG. 1B'), the force drops to 85 tons, an average force of 15 tons being necessary to open the fingers 6A. Said opening force must not be less than 10 tons, for example, since then the fingers do not open, nor greater than 20 tons as this could damage the female connector. The jacks used for said step must therefore be sufficiently sensitive to lie within the above-mentioned limits.

During the step of FIG. 1C' which corresponds to the opening of the fingers 6A and their contact with the step 7A, the force further increases.

During step of FIG. 1D' (platform immersion) the force suddenly increases to values of the order of 800 to 1000 tons. Only the use of powerful jacks allow this step to be performed.

It is therefore seen that jacks with a force of 100 tons would be incapable of performing the step of FIG. 1D' the process, but that jacks with a force of 1000 tons would not have the sensitivity required to perform step E. Only the use of two groups of jacks which can be brought into action successively and/or simultaneously makes it possible to solve the problem thus set.

Each jack is connected to a damping device.

Figure 7A:
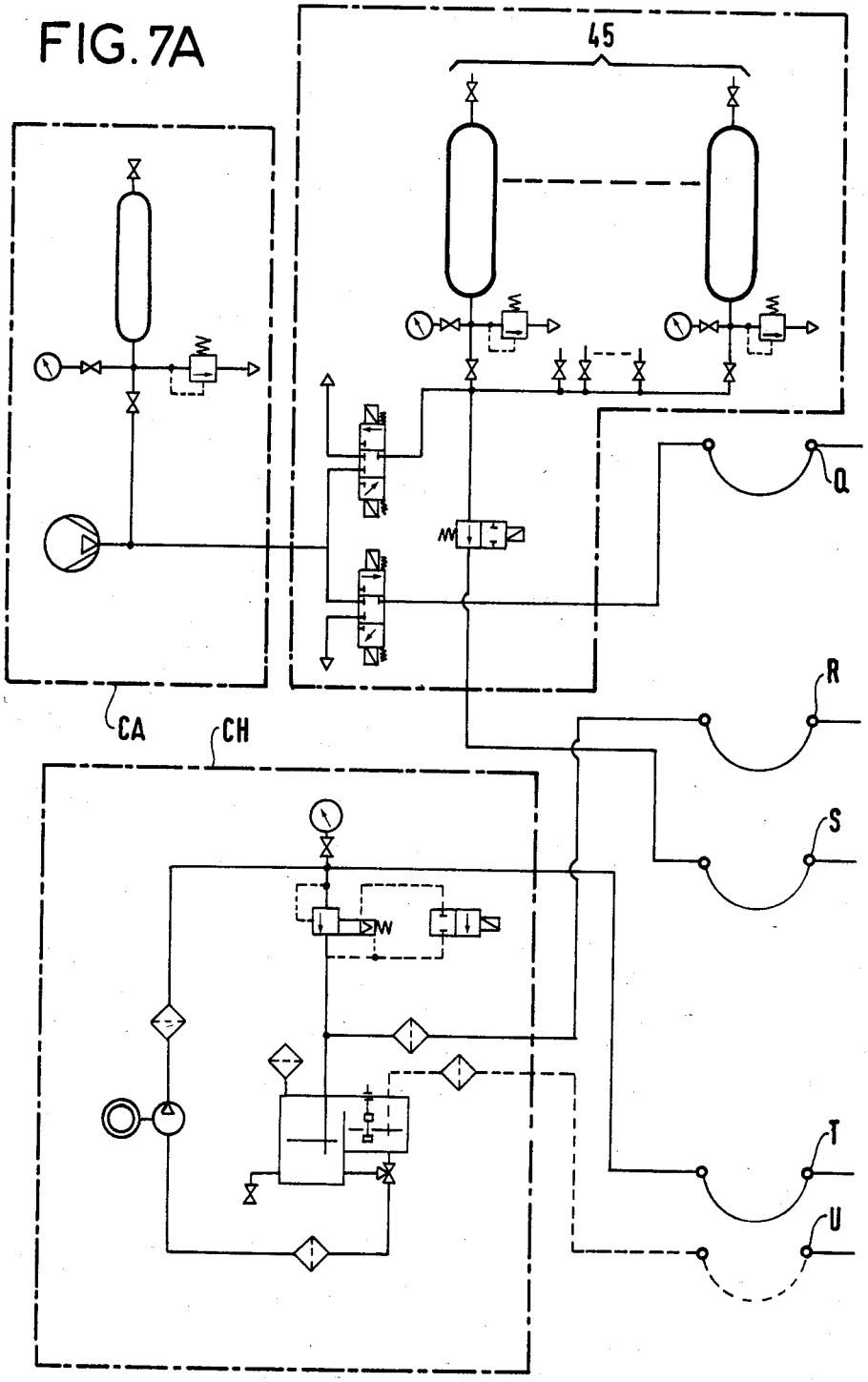
FIG. 7A and 7B are respectively a hydraulic and a pneumatic circuit diagram for the device.
Figure 7B:
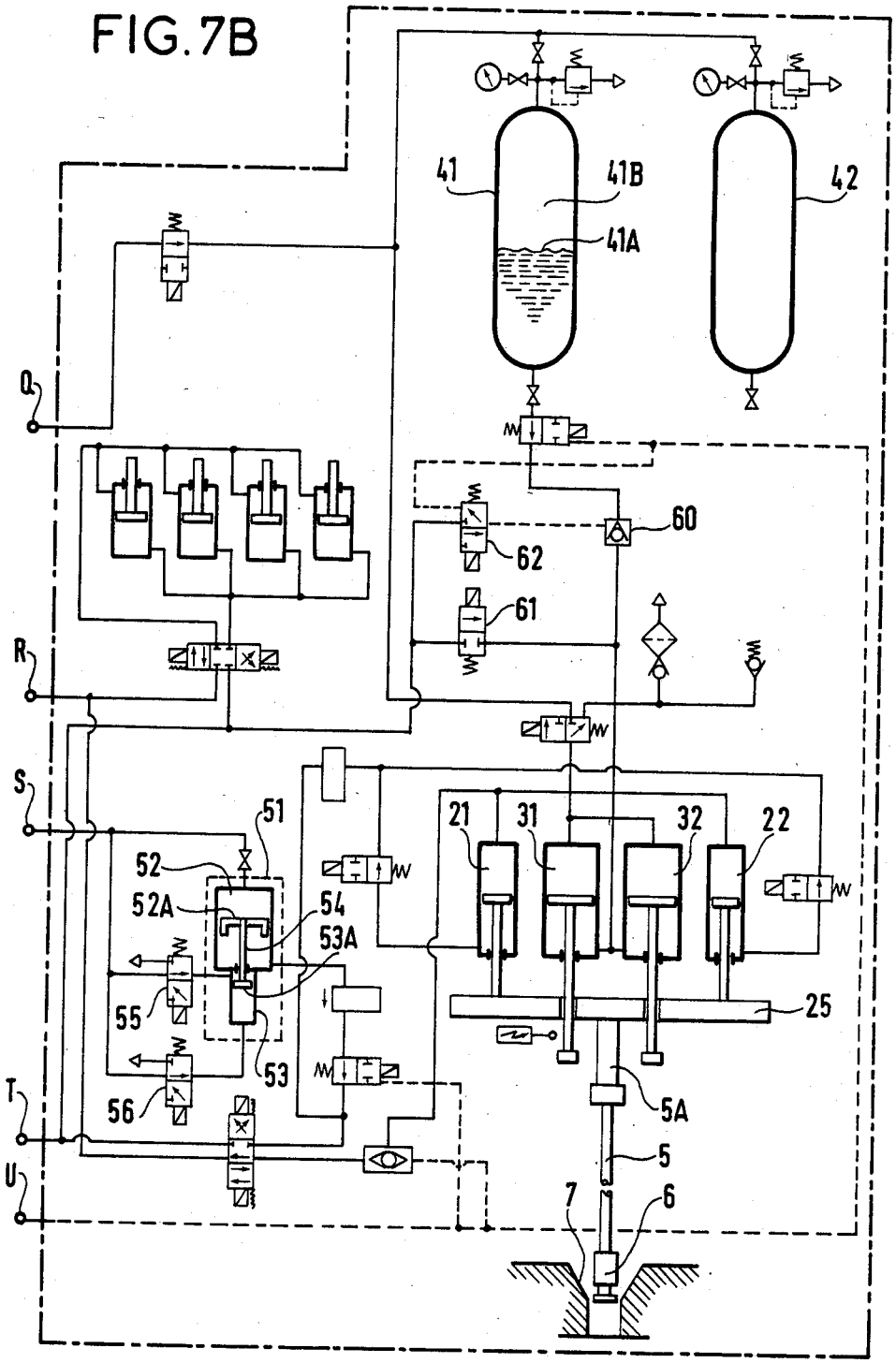
Figures 8A, 8B, 8C, 8D:
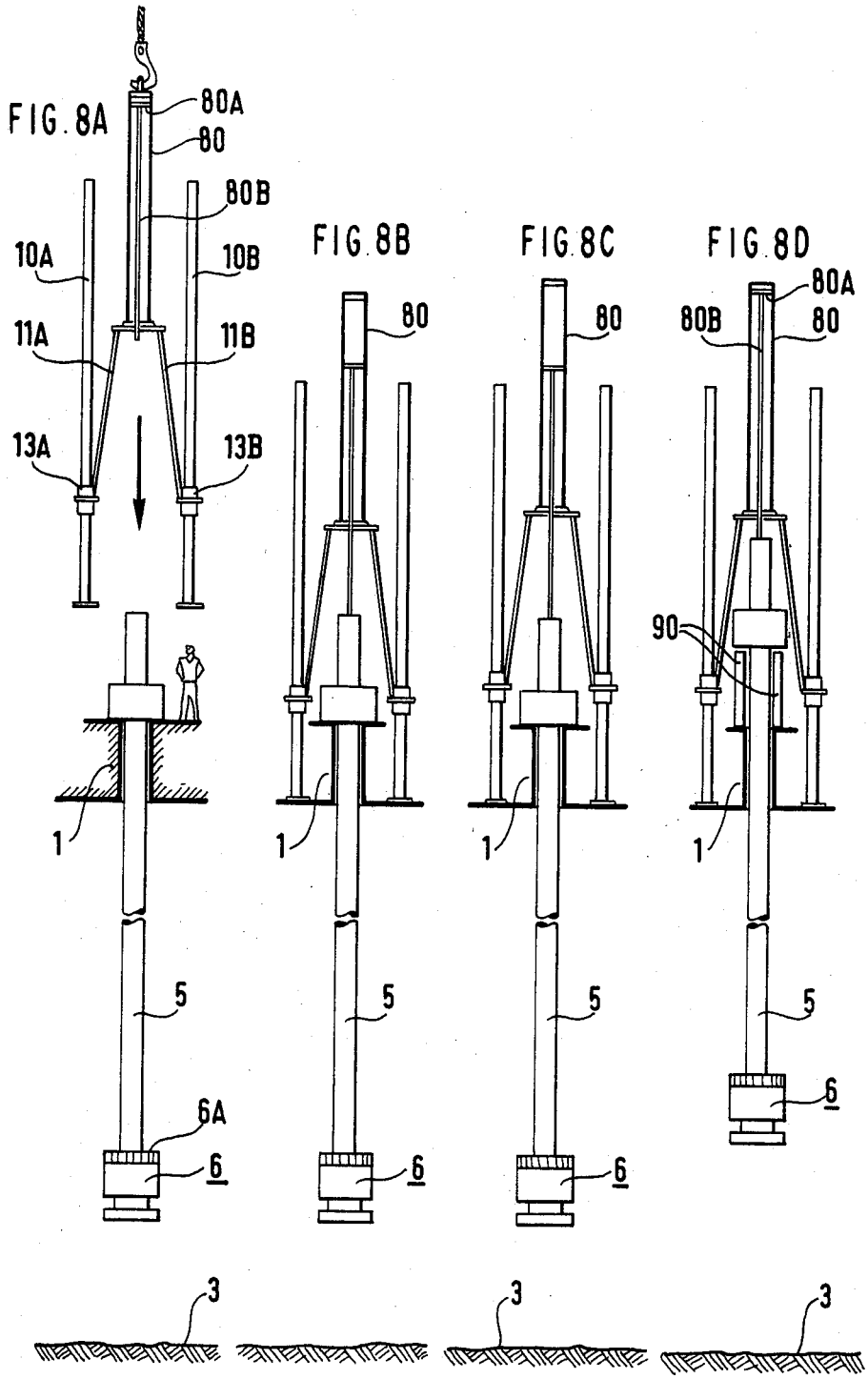
FIGS. 8A-8D, 9E-9H, 10I-10L and 11M-11P are diagrams showing the device during the various steps of operation.
Figures 9E, 9F, 9G, 9H:
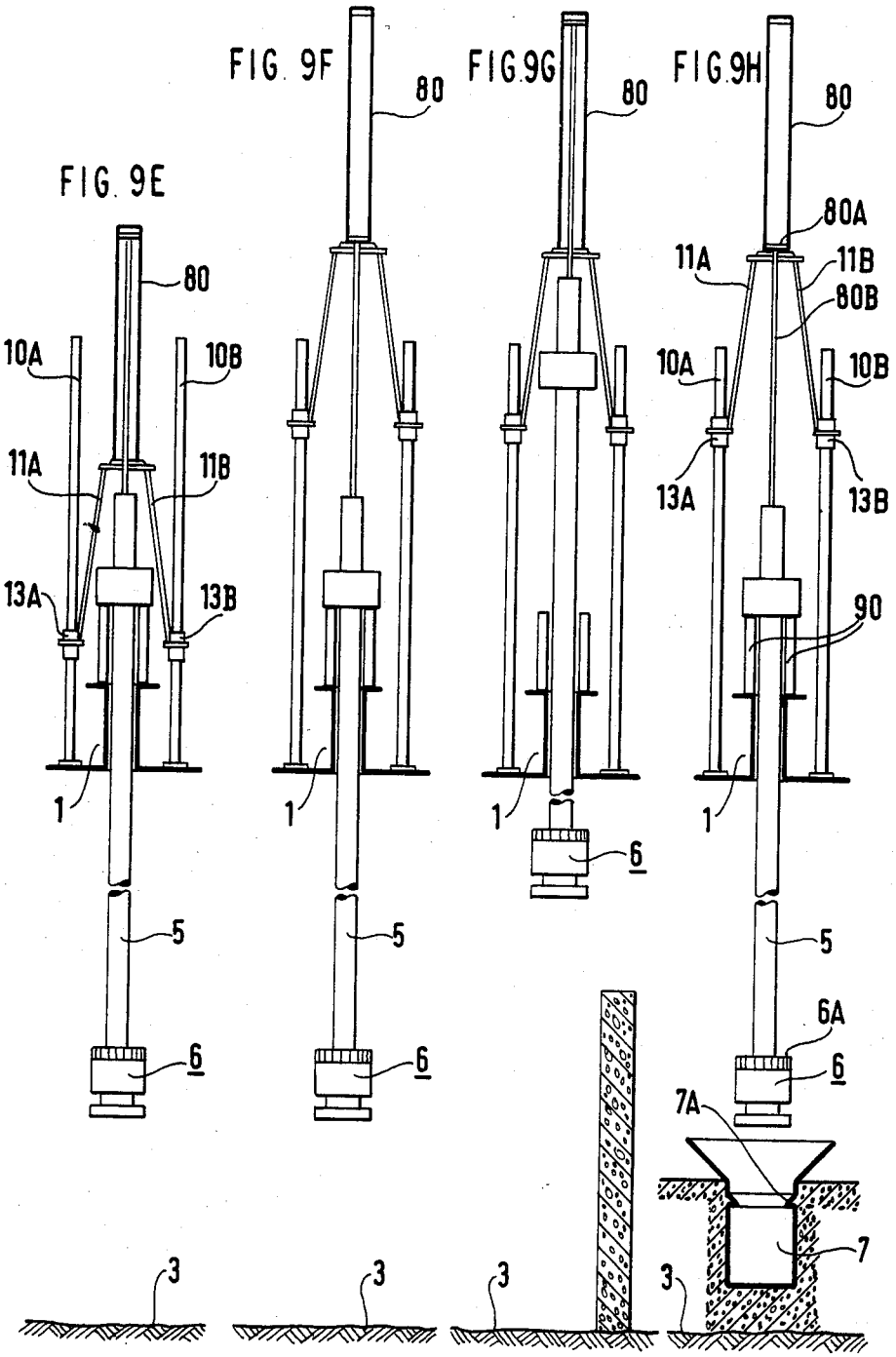
Figure 10I:
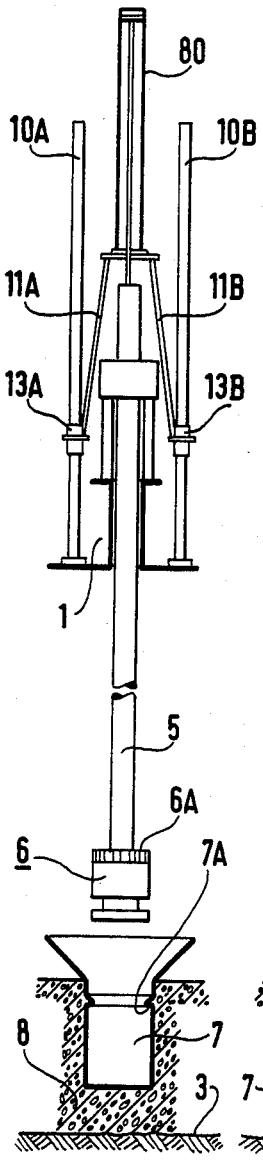
Figure 10J:
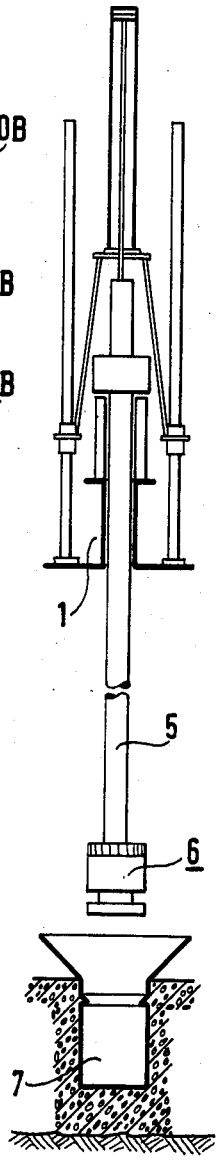
Figure 10K:
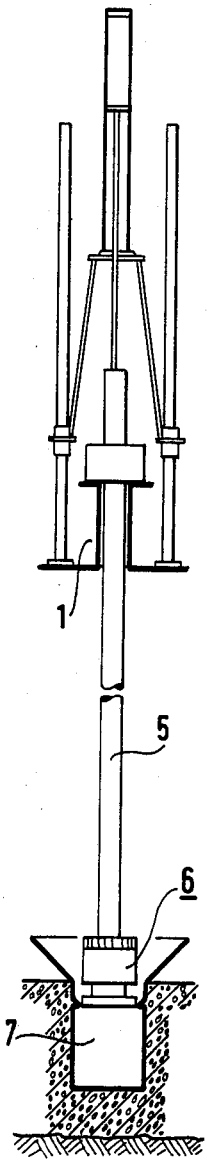
Figure 10L:
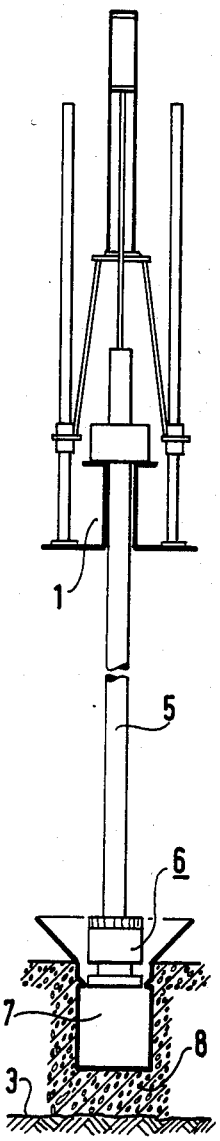
Figure 11M:
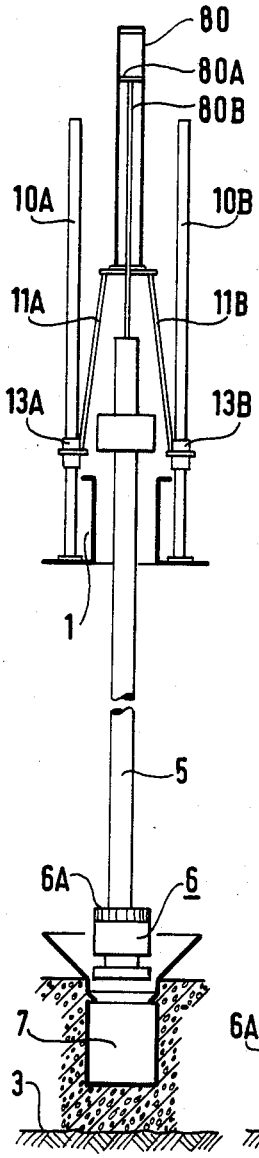
Figure 11N:
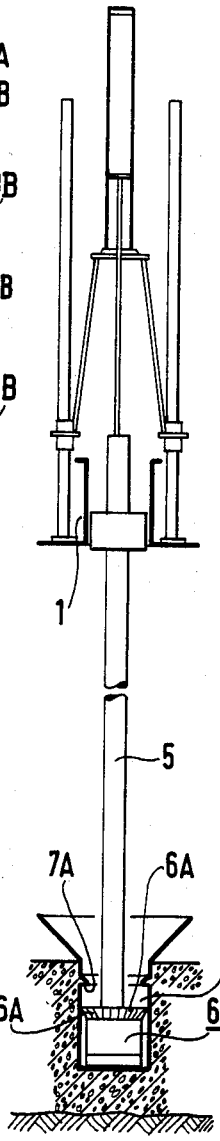
Figure 11O:
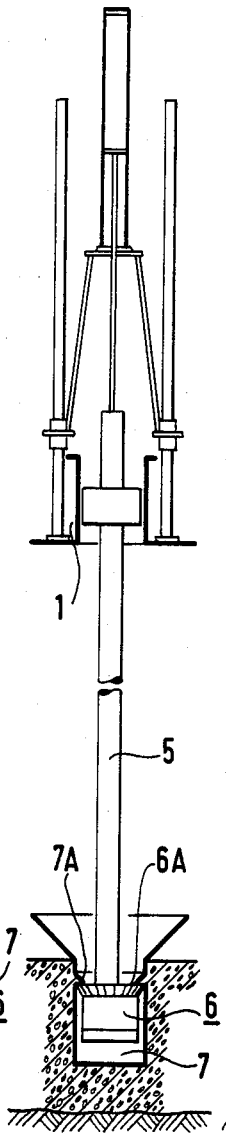
Figure 11P:
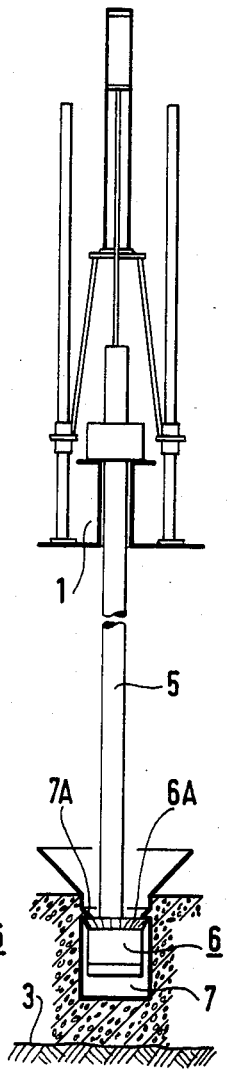

FIGS. 7A and 7B illustrate the jack control circuits and the jack damping devices.

To read the diagram, the figures are placed side by side with the points marked Q, R, S, T, U. coinciding.

In these diagrams (FIGS. 7A and 7B) the jacks 21, 22, 31 and 32 are connected as set forth hereinabove to the plate 25.

Figure 4:
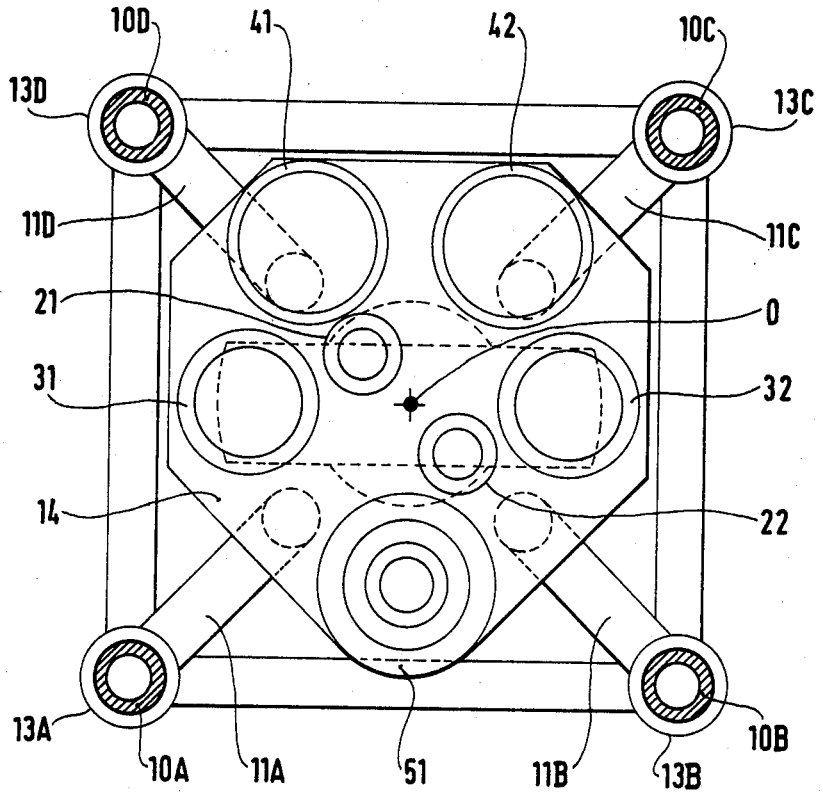
FIG. 4 is a plan view from above the same device.
Figure 5:
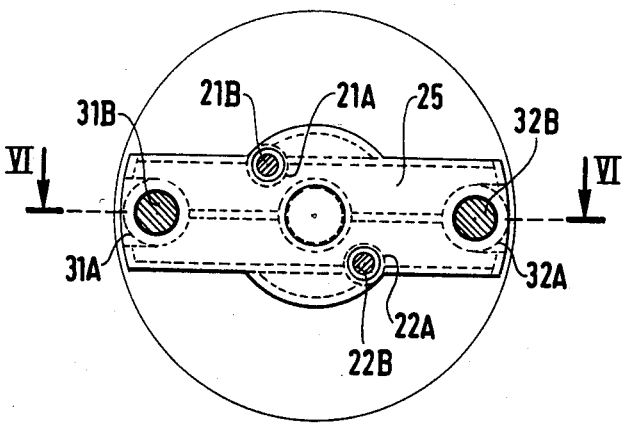
FIG. 5 is a cross-section of the device along line V—V of FIG. 2.
Figure 6:
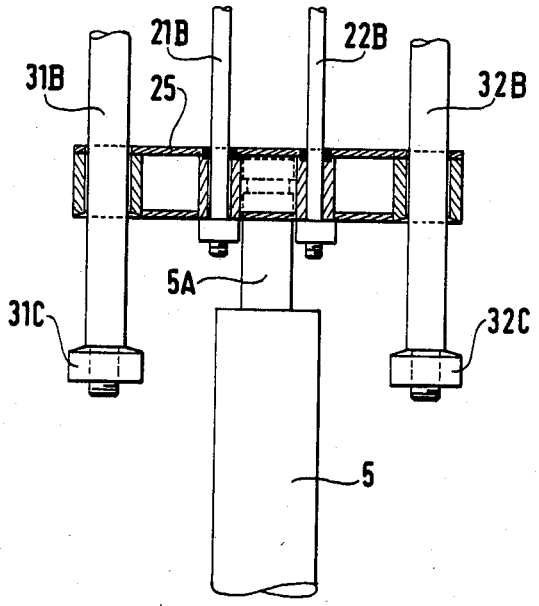
FIG. 6 is a cross-section of the device along line VI—VI of FIG. 5.

The damping means for the jacks 31 and 32 are constituted by an accumulator 41 divided into an oil compartment 41A and an air compartment 41B to which are added if necessary a second air tank 42. The accumulator and the tank are disposed in the frame as illustrated in FIG. 4.

The damper 51 of the jacks 21 and 22 which is described in detail hereinafter is also disposed in the frame.

The air necessary for the operation of said damper is supplied by a series of cylinders 45.

The rectangles CA and CH designate respectively an air compressor and an oil compressor.

All the other symbols in FIGS. 7A and 7B are conventional symbols which are universally adopted and do not require to be listed in detail.

Two particularities of the assembly which form part of the present invention should be noted.

The first particularity is that the jacks 31 and 32 are connected to the oil chamber end of the damper 41 via a non-return valve 60.

The above disposition has the following advantages: at the end of the connector connection step, the jacks 31 and 32 are retracted so that the stops of the rods come into contact with the plate and that the continuation of the jack movement causes partial immersion of the platform.

An electrically controlled cock 61 actuates a valve 60 to position it either so that it allows the jacks to move in both directions so that their rods can follow the movments due to pounding resulting from the action of the swell or else to make it act as a non-return valve. During the platform immersion step and during the periods when pounding causes the platform to be lowered, the non-return valve is on and oil is thus allowed to pass into the jack lower compartments. At the bottom dead centre, the non-return valve prevents the oil from flowing back into the damping means 41. The energy necessary to immerse the platform is thus partially derived from the sea itself due to the pounding caused by the swell.

The second particularity of the oil and air circuit is the kind of accumulator 51 which used.

Said accumulator is constituted by two components 52 and 53, each of which has a piston 52A and 53A connected together by a single rod 54.

The compartment above the piston 52A is connected to the compressed air source. The compartment below the piston 52A is connected to the jacks 21 and 22.

The compartments above and below the piston 53A are connected to the source 45 via electrically operated valves 55 and 56.

The above configuration makes it possible to vary the stiffness of the damping means, which force is used as follows:

a/ Rod lowering step, in which the rods weigh 106 tons, for example; the electrically operated valves 55 and 56 are cocked simultaneously. The damping means has been calculated to come into action in these conditions.

b/ Contact step during which the male connector comes into contact with the female connector. The apparent weight of the assembly is reduced to 90 tons, for example. Only the valve 56 is cocked and the valve 55 makes the corresponding compartment communicate with the atmosphere.

The effect of the air on the piston 52A is subtracted from that which affects the piston 53A whose cross-section is smaller. The stiffness of the damping means is thus adapted to the new conditions.

c/ Rod set raising step and beginning of immersion step before the jacks 31 and 32 come into action. The weight increases to 116 tons, then to 150 tons. Neither the valve 55 nor the valve 56 are actuated. The piston 52A becomes a pressure multiplier. Here again, the stiffness of the damping system varies according to the variation of the load.

FIGS. 8A–8D, 9E–9H, 10I–10L and 11M–11P illustrate how the device in accordance with the invention should be used. The jacks are symbolically shown by a single jack 80 whose cylinder is referenced 80A and whose rod is referenced 80B.

FIGS. 8A–8D

A/ Lowering of the device in accordance with the invention onto the platform in line with the set of rods 5, which is previously set in position and fixed to the platform.

B/ Fixing the device to the platform, partial lowering of the piston rod 80B and fixing to the set of rods.

C/ Upward movement of the cylinders without movement of the set rods.

D/ Raising the set of rods by actuating the jack and installing props 90 to support the set of rods.

FIGS. 9E–9H

E/ The jack bears on the props.

F/ Upward movement of the cylinder without movement of the set of rods.

G/ Second raising of the set of rods by movement of the frame along the beams.

H/ Bringing the set of rods above the female connector and partial lowering until the rods abut against the props.

FIGS. 10I–10L

I/ Lowering of the cylinders until they abut against the props without movement of the set of rods.

J/ A small movement of the set of rods only upwards to allow the props to be removed.

K/ A downward movement of the set of rods for the male connector to engage in the female connector.

L/ Lowering of the cylinders without movement of the set of rods.

FIGS. 11M–11P

M/ The set of rods is slightly raised by means of the jacks 21 and 22 alone to stop the operation of the jacks 31 and 32.

N/ The set of rods is lowered as far as it will go and the fingers of the male connector are splayed out.

O/ The set of rods is raised until the fingers of the male connector abut against the step of the female connector.

P/ Movement of the jacks to partially immerse the platform.

The set of rods is fixed to the platform at the end of immersion.

The device in accordance with the invention has the advantages of versatile use; four devices one at each corner of a platform can be controlled simultaneously and allow the first four sets of rods to be installed easily. The other trains of rods will be installed and tension applied thereto in an analogous manner.

We claim:

1. A device for positioning and applying tension to a set of raising and lowering rods for immersing and holding a partially submerged platform relative to a set of connectors fixedly mounted in an underlying seabed, said device including: a submergible platform, a metal frame supported by said platform, means for vertically moving said frame relative to said platform including at least one jack of a first sensitive type which has a cylinder and a rod, at least one jack of a second high power type which has a cylinder and a rod, the cylinders of said at least one jacks of both types being fixed to said frame and being disposed in such a way that the rods of said cylinders move vertically, the rod of the jack of the first type being fast to a plate which is provided firstly with an orifice through which the rod of the second type of jack passes through and secondly with means fixing said plate to one end of the set of raising and lowering rods for raising and lowering said set of rods, said raising and lowering rods terminating at their other ends in raising and lowering rod connectors for engagement with the connectors fixedly mounted on the seabed; whereby, tension may be exerted through the raising and lowering rods capable of pulling the platform downwardly and partially submerging said platform, the rod of said second type of jack having a stop at its end for contacting said plate about said orifice, the rods of the jacks of both types being of unequal length, which lengths are chosen such that the high power second type jack drives the plate only in a platform immersion step, and wherein said at least one jack of the first type functions to raise and lower said sets of rods to effect connection and disconnection between the connectors of said set of raising and lowering rods and said connectors fixedly mounted in the seabed, and wherein said at least one jack of said second type functions solely to exert tension on said set of raising and lowering rods, after connection to said connectors fixedly mounted on said seabed to effect partial submersion of said platform.

2. A device according to claim 1, wherein the means for moving the frame include sliders mounted to slide along beams to which the platform can be made fast.

3. A device according to claim 1, wherein each jack is connected to damping means.

4. A device according to claim 2, wherein the damping means is disposed inside the frame.

5. A device according to claim 3, wherein the damping means for damping the jack of the second type is a tank partially filled with oil and compressed air and communicating with the jacks via a controllable non-return valve.

6. A device according to claim 3, wherein the damping means for damping the jack of the first type is a device with two cylinders and two pistons which are connected together by a single rod, the first piston delimiting in the first cylinder two compartments respectively connected to said jacks and to a compressed gas source, the second piston delimiting in the second cylinder two chambers each communicating via a controllable valve with either a compressed gas source or the atmosphere.

* * * * *